US009797221B2

(12) United States Patent
Themig et al.

(10) Patent No.: US 9,797,221 B2
(45) Date of Patent: Oct. 24, 2017

(54) APPARATUS AND METHOD FOR FLUID TREATMENT OF A WELL

(75) Inventors: Daniel Jon Themig, Calgary (CA); Robert Joe Coon, Missouri City, TX (US); John Lee Emerson, Katy, TX (US)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 616 days.

(21) Appl. No.: 13/821,410

(22) PCT Filed: Sep. 23, 2011

(86) PCT No.: PCT/CA2011/001066
§ 371 (c)(1),
(2), (4) Date: Mar. 7, 2013

(87) PCT Pub. No.: WO2012/037661
PCT Pub. Date: Mar. 29, 2012

(65) Prior Publication Data

US 2013/0168090 A1 Jul. 4, 2013

Related U.S. Application Data

(60) Provisional application No. 61/385,889, filed on Sep. 23, 2010, provisional application No. 61/537,403, filed on Sep. 21, 2011.

(51) Int. Cl.

| | |
|---|---|
| ***E21B 34/14*** | (2006.01) |
| ***E21B 43/14*** | (2006.01) |
| ***E21B 43/25*** | (2006.01) |
| *E21B 34/00* | (2006.01) |

(52) U.S. Cl.
CPC ..... *E21B 34/14* (2013.01); *E21B 43/14* (2013.01); *E21B 43/25* (2013.01); *E21B 2034/007* (2013.01)

(58) Field of Classification Search
None
See application file for complete search history.

(56) References Cited

U.S. PATENT DOCUMENTS

| | | | |
|---|---|---|---|
| 958,100 | A | 5/1910 | Decker |
| 2,177,172 | A | 10/1939 | Crowell |
| 2,287,076 | A | 6/1942 | Zachry |
| 2,903,074 | A | 9/1959 | Layton et al. |

(Continued)

FOREIGN PATENT DOCUMENTS

| | | | |
|---|---|---|---|
| CA | 2625662 | A1 | 11/2008 |
| EP | 2360347 | | 9/2006 |

(Continued)

*Primary Examiner* — Caroline Butcher
(74) *Attorney, Agent, or Firm* — Bennett Jones LLP

(57) ABSTRACT

A wellbore fluid treatment apparatus includes a tubing string including a first port with a first closure disposed thereover to close the first port to fluid flow and a second port spaced axially uphole from the first port and having a second closure disposed thereover to close the second port to fluid flow; and an actuator tool configured to move through the tubing string and (i) to set a seal in the tubing string downhole of the first port; (ii) to actuate the first closure to open the first port; and (iii) to actuate the second closure to open the second port. A method for treating a well may employ the tool.

25 Claims, 8 Drawing Sheets

(56) References Cited

U.S. PATENT DOCUMENTS

| | | | | |
|---|---|---|---|---|
| 2,922,479 | A | 1/1960 | Kinley | |
| 3,051,143 | A | 8/1962 | Nee | |
| 3,095,040 | A | 6/1963 | Bramlett | |
| 3,924,677 | A | 12/1975 | Prenner et al. | |
| 4,068,712 | A | 1/1978 | Stump | |
| 4,154,303 | A | 5/1979 | Fournier | |
| 4,374,543 | A | 2/1983 | Richardson | |
| 4,378,839 | A | 4/1983 | Fisher, Jr. | |
| 4,566,541 | A | 1/1986 | Moussy et al. | |
| 4,577,702 | A | 3/1986 | Faulkner | |
| 4,601,343 | A | 7/1986 | Lindsey, Jr. et al. | |
| 4,603,741 | A | 8/1986 | Edgmon | |
| 4,693,314 | A | 9/1987 | Wesson et al. | |
| 4,729,432 | A | 3/1988 | Helms | |
| 4,846,272 | A | 7/1989 | Leggett | |
| 4,893,678 | A * | 1/1990 | Stokley et al. | 166/374 |
| 4,917,191 | A | 4/1990 | Hopmann et al. | |
| 5,012,871 | A | 5/1991 | Pleasants et al. | |
| 5,413,180 | A | 5/1995 | Ross et al. | |
| 5,526,881 | A | 6/1996 | Martin et al. | |
| 5,803,173 | A | 9/1998 | Fraser, III et al. | |
| 6,003,607 | A | 12/1999 | Hagen et al. | |
| 6,006,838 | A * | 12/1999 | Whiteley et al. | 166/306 |
| 6,138,764 | A * | 10/2000 | Scarsdale | E21B 23/08 166/117.6 |
| 6,220,316 | B1 | 4/2001 | Lin | |
| 6,220,356 | B1 | 4/2001 | Spikes | |
| 6,382,324 | B1 | 5/2002 | Anyan | |
| 6,397,950 | B1 | 6/2002 | Streich et al. | |
| 6,763,892 | B2 | 7/2004 | Kaszuba | |
| 6,920,930 | B2 | 7/2005 | Allamon et al. | |
| 6,945,331 | B2 | 9/2005 | Patel | |
| 6,997,263 | B2 | 2/2006 | Campbell et al. | |
| 7,051,812 | B2 | 5/2006 | McKee et al. | |
| 7,287,596 | B2 | 10/2007 | Frazier et al. | |
| 7,387,165 | B2 | 6/2008 | Lopez de Cardenas et al. | |
| 7,431,091 | B2 | 10/2008 | Themig et al. | |
| 7,533,727 | B2 | 5/2009 | Barton et al. | |
| 7,543,634 | B2 | 6/2009 | Fehr et al. | |
| 7,673,677 | B2 | 3/2010 | King et al. | |
| 7,703,510 | B2 | 4/2010 | Xu | |
| 7,708,066 | B2 | 5/2010 | Frazier | |
| 7,730,949 | B2 | 6/2010 | Guignard et al. | |
| 7,748,460 | B2 | 7/2010 | Themig et al. | |
| 7,823,633 | B2 * | 11/2010 | Hartwell | 166/66.6 |
| 2002/0170719 | A1 * | 11/2002 | Deaton | 166/373 |
| 2003/0127227 | A1 | 7/2003 | Fehr et al. | |
| 2004/0035586 | A1 | 2/2004 | Gudmestad et al. | |
| 2006/0124310 | A1 * | 6/2006 | Lopez de Cardenas | E21B 34/06 166/313 |
| 2006/0207764 | A1 | 9/2006 | Rytlewski | |
| 2007/0221373 | A1 | 9/2007 | Murray | |
| 2007/0272411 | A1 | 11/2007 | Lopez de Cardenas et al. | |
| 2008/0156498 | A1 | 7/2008 | Phi et al. | |
| 2008/0289813 | A1 | 11/2008 | Gewily et al. | |
| 2009/0044944 | A1 * | 2/2009 | Murray | E21B 43/02 166/308.1 |
| 2009/0065194 | A1 | 3/2009 | Frazier | |
| 2009/0084553 | A1 | 4/2009 | Rytlewski et al. | |
| 2009/0139717 | A1 | 6/2009 | Richard et al. | |
| 2009/0159279 | A1 | 6/2009 | Assal | |
| 2010/0000727 | A1 | 1/2010 | Webb et al. | |
| 2010/0038096 | A1 | 2/2010 | Reimert et al. | |
| 2010/0263873 | A1 | 10/2010 | Turner et al. | |
| 2010/0282469 | A1 | 11/2010 | Richard et al. | |
| 2011/0030968 | A1 | 2/2011 | Xu | |
| 2011/0030976 | A1 | 2/2011 | King | |
| 2011/0079391 | A1 | 4/2011 | Bedouet et al. | |
| 2011/0088908 | A1 | 4/2011 | Xu | |
| 2011/0192613 | A1 | 8/2011 | Garcia et al. | |
| 2012/0292032 | A1 | 11/2012 | Themig et al. | |
| 2014/0151052 | A1 | 6/2014 | Themig et al. | |

FOREIGN PATENT DOCUMENTS

| | | |
|---|---|---|
| GB | 2258478 | 2/1993 |
| WO | WO 2008/119931 | 10/2008 |
| WO | WO 2009/029437 A1 | 3/2009 |
| WO | WO 2009/132462 | 5/2009 |
| WO | WO 2010/025150 A2 | 3/2010 |
| WO | WO 2011/079391 | 7/2011 |
| WO | WO 2011/079391 A1 | 7/2011 |
| WO | WO 2011/097632 A1 | 8/2011 |
| WO | WO 2011/100748 | 8/2011 |

* cited by examiner

APPARATUS AND METHOD FOR FLUID TREATMENT OF A WELL

FIELD

The invention relates to a wellbore apparatus and method and, in particular, a wellbore apparatus and method for staged fluid treatment of a well.

BACKGROUND

Apparatus and methods are required for effectively and efficiently fluid treating a well. Stimulations such as fracturing are required along long lengths in certain wells and it is difficult to ensure that the fluid treatment is regularly and effective achieved along the entire length, but also in a reasonable time.

Previous solutions have been proposed by Packers Plus Energy Services Inc. including in U.S. Pat. No. 7,748,460. The proposed systems employ a range of plug sizes to actuate different sleeves along the injection string to open. The proposed systems work well to treat a plurality of intervals along the well, but some operators want to segment the well into greater numbers of intervals than can be achieved by using one ball size matched to one sleeve and the number of intervals may sometimes be limited by the number of different plug sizes that can be employed.

SUMMARY

In accordance with a broad aspect of the present invention, there is provided a wellbore fluid treatment apparatus comprising: a tubing string including a first port with a first closure disposed thereover to close the first port to fluid flow and a second port spaced axially uphole from the first port and having a second closure disposed thereover to close the second port to fluid flow; and, an actuator tool configured to move through the tubing string and (i) to set a seal in the tubing string downhole of the first port; (ii) to actuate the first closure to open the first port; and (iii) to actuate the second closure to open the second port.

In accordance with another broad aspect of the present invention, there is provided a method for fluid treating a wellbore through a tubing string including a first port with a first closure disposed thereover to close the first port to fluid flow and a second port spaced axially uphole from the first port and having a second closure disposed thereover to close the second port to fluid flow, the method comprising: running into an inner diameter of the tubing string with an actuator tool; manipulating the actuator tool to set a seal in the inner diameter downhole of the first port; pulling the actuator tool up to the first port; actuating the first closure with the actuator tool to open the first port; pulling the actuator tool up to the second port; actuating the second closure with the actuator tool to open the second port; and injecting wellbore treatment fluid into the tubing string inner bore, the wellbore treatment fluid being diverted by the seal out through the first port and the second port.

In accordance with another broad aspect of the present invention, there is provided a flapper ball seat comprising: a tubular housing; an annular mount positioned in the tubular housing; and a plurality of ball seat segments pivotally connected by pivotal connections to the annular mount, the plurality of ball seat segments pivotal about their pivotal connections from a stored position to an active position where the plurality of ball seat segments fit together to form a ball seat with a central ball seat opening.

In accordance with another broad aspect of the present invention, there is provided a method for sealing an inner diameter of a wellbore tubing string, the method comprising: providing a stored ball seat in a tubular section of the tubing string, the stored ball seat including an annular mount positioned in the tubular housing; and a plurality of ball seat segments pivotally connected by pivotal connections to the annular mount and held in a retracted position adjacent an inner wall of the tubular section; releasing the plurality of ball seat segments to pivot radially inwardly toward a center axis of the tubular section to assume an active position where the plurality of ball seat segments fit together to form a ball seat with a central ball seat opening substantially concentric about the center axis; and introducing a plug to the tubing string to pass through the string and land on the ball seat opening.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein:

FIG. 2 is a side elevation of a shifting tool.

FIG. 3 is a series of sectional views through a port closure.

FIG. 5 is a side elevation of an actuator tool.

DETAILED DESCRIPTION OF VARIOUS EMBODIMENTS

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. The drawings are not necessarily to scale and in some instances proportions may have been exaggerated in order more clearly to depict certain features. Throughout the drawings, from time to time, the same number may be used to reference similar, but not necessarily identical, parts.

Figure 1:
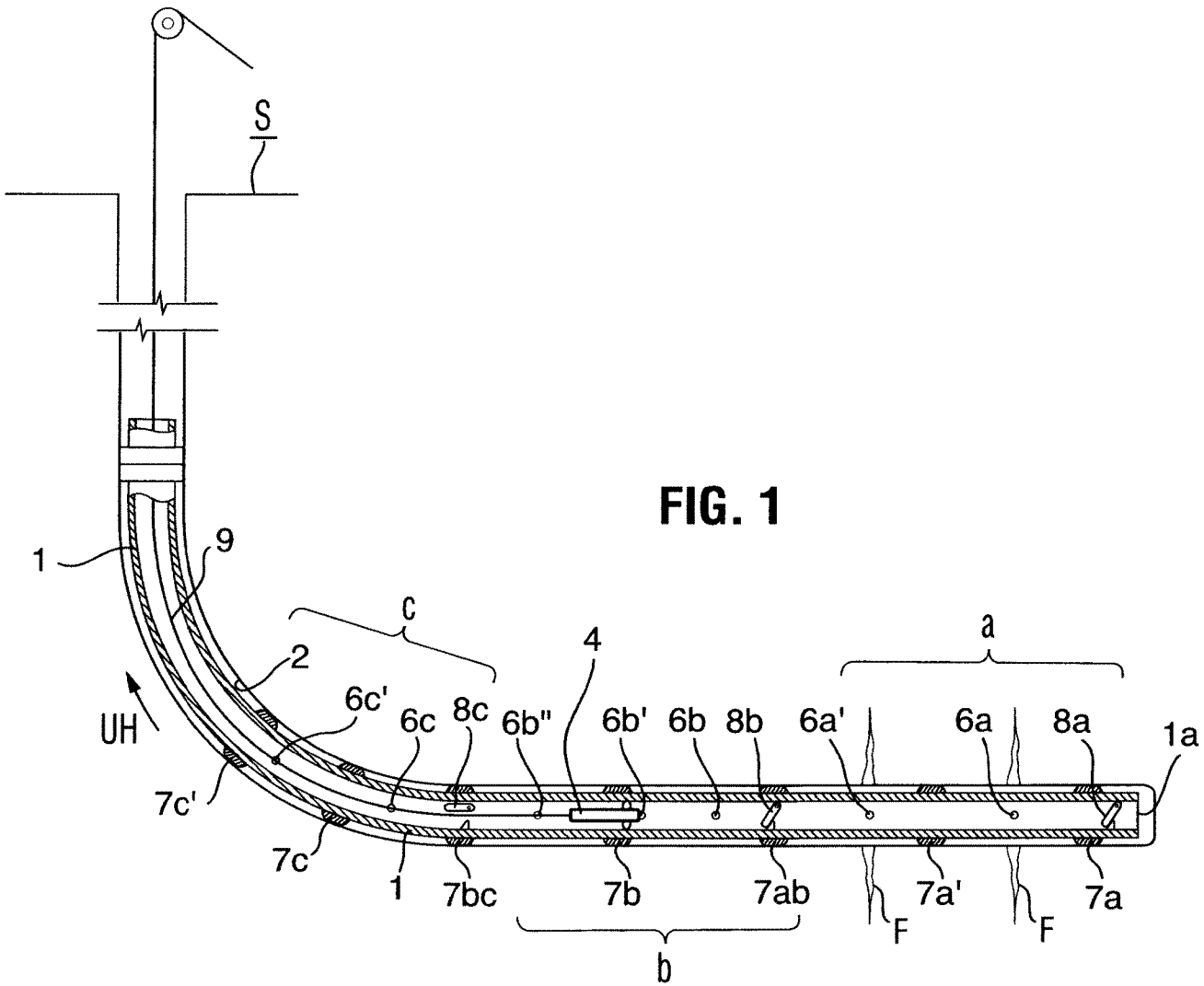
FIG. 1 is a schematic view of an apparatus for wellbore fluid treatment installed in a well according to an aspect of the invention.

With reference to FIG. 1, an apparatus according to the invention includes a ported tubing string 1 for placement in a wellbore, defined by a wall 2, and an actuation tool 4 for actuation of various components of the tubing string. Tubing string 1 includes at least one, and likely, as shown, a plurality of stages a, b, c along its length. Each stage includes a settable tubing string inner diameter seal 8*a*, 8*b*, 8*c* (collectively identified as seals 8), one or more ports 6*a*, 6*a*', 6*b*, 6*b*', 6*b*", 6*c*, 6*c*' (collectively referenced as ports 6) and at least a pair of packers 7*a*, 7*a*', lab, 7*b*, 7*bc*, 7*c*, 7*c*' (collectively referenced as ports 7). In each stage, the seal 8 is positioned downhole of, in other words closer to the tubing's distal end 1*a* than, the one or more ports 6. Packers 7 encircle the string's outer surface and straddle the one or more ports 6. Actuation tool 4 is run inside ported tubing string 1 and is manipulated by connection to a line 9 from surface to carry out various functions in the string, including opening the string's ports 6 and setting a tubing string inner diameter seal 8.

In a method for wellbore treatment, string 1 is installed in the well 2 with all ports 6 closed and all seals 8 open. Packers 7 are then set to create isolated intervals therebetween along the wellbore, each interval accessed by at least one port 6. Tool 4 is then conveyed into the string to actuate the ports and seals in stages a, b, c such that they can have wellbore treatment fluid injected therethrough to treat the wellbore zones accessed by the stages. In the illustrated embodiment, a wellbore fluid treatment has already been effected through stage a. In particular, tool 4 has already been employed to set seal 8*a* and open ports 6*a*, 6*a*' and a fluid treatment has been conducted through string 1, such that for example, the wellbore has been fractured F through the intervals accessed through ports 6*a*, 6*a*'. Seal 8*a* being set, closes the inner diameter 1*a* of the string to flow downwardly therepast; packers 7*a*, 7*a*', 7*ab* being expanded prevent annular migration of fluids; and all other ports are closed, such that any fluid introduced to string 1 from surface S is stopped by seal 8*a* and must exit the string through ports 6*a*, 6*a*' to treat the well accessed through these ports. In the illustrated embodiment, tool 4 is being employed to ready stage b for fluid treatment. In particular, tool 4 has already been employed to set seal 8*b*, to create a seat against fluid flow from stage b to stage a. Tool 4 has also opened ports 6*b*, 6*b*' and is being pulled up hole (arrow UH, toward surface) toward port 6*b*", which is currently closed but is soon to be opened. After port 6*b*" is opened, a fluid treatment can be conducted through string 1 to treat the wellbore through the intervals accessed through ports 6*b*, 6*b*', 6*b*". Packers 7*ab*, 7*b*, 7*bc* will prevent annular migration of fluids into other areas of the well, such that any fluid is focused in those accessed intervals.

Seal 8*c* remains unset during the above-noted operations in stages a and b such that it allows tool 4 and any injected fluids to pass. However, after treatment of stage b, when it is desired to treat stage c, tool 4 will be actuated to close seal 8*c* and open ports 6*c*, 6*c*' such that fluid can be pumped to access the wellbore exposed in the intervals isolated by packers 7*bc*, 7*c* and 7*c*'.

During the fluid treatment after the particular group of ports has been opened, the actuation tool 4 may remain in place or be tripped to surface. If the actuation tool is tripped to surface, for example after opening ports 6*b*, 6*b*' and 6*b*", it can be configured to pass by any ports between those opened and surface, such as ports 6*c*, 6*c*', during the trip out without opening them. As such, the port opening function of the actuation tool is either selective or non-selective but disengagable. So the tool function that opens the ports may be selective in that the tool can only open that selected group of ports in any one operation or it can be non-selective, but controlled to only open a selected group before its port opening function is deactivated. For example, the port opening function can be selective to open only certain ports with which it is intended to mate. Alternately, the port opening functionality of the tool can be non-selective and can be disengaged as by electrical mechanisms or by shearing out opening tools. For example, in one embodiment, the tubing string includes a deactivation nipple above the uppermost port of each group and the tool is configured to be pulled through the string and open the ports of the group, but when it is pulled into the deactivation nipple, the nipple's profile shears out the opening tools. The activation tool can then be tripped to surface without manipulating any further ports. As such, because there may be several other groups of ports above the selected groups, the tool is able to pass those ports without opening them. In particular, once the selected group of ports is in the open position, the opening function of the tool can be disengaged, allowing it to be pulled up past any remaining ports without opening them. Thus, there can be many groups of ports and tool 4 can be run down to open the group of interest, while the tool passes other groups both on the way down and the way back up, without affecting those groups.

If the tool is not tripped to surface between the frac treatments, the tool's port opening mechanism may remain activated or a full activated opening tool may be employed where opening dogs are actuated by pumping down the conveyance tube before the tool is pulled through the next group of ports. If the tool remains in the well during a fluid treatment and it remains above the opened ports, any tool component, such as an annular seal, that would hinder the fluid treatment must be de-activated. Alternately, if the tool remains in the well during a fluid treatment, the tool may be moved below the opened ports. This also removes the body of the tool down below the treatment ports such that the fluid treatment flow path remains generally unobstructed. However, this requires a capability to move the tool down, such as a line 9 that can apply a push force.

Once treatments are finished on any intervals accessed through the group of opened ports, actuation tool can employed to open further intervals. For example, after ports 6*b*, 6*b*', 6*b*" have been opened and fluid treatment is completed therethrough, tool 4 can be employed to open ports 6*c*, 6*c*". If tool 4 has been tripped out, the tool is run back in. If the tool has a selective port opening function, it may have been reconfigured to employ a different selective mechanism. If the tool has a non-selective, but sheared out, port opening function, the shear tools may have been reset or reinstalled. Once in position, tool 4 will set seal 8*c*, which is up hole of the uppermost port 6*b*" opened in the previous operation, and tool 4 will open another grouping of ports 6*c*, 6*c*' uphole of seal 8*c*. Once those ports are open, with the third seal set below, the multiple intervals accessed by the third group of ports can be fraced. The process can be repeated as many times as desired, until well treatment is completed.

If the tubing string is to be employed for flowing back, any seals 8 may be openable, at least to flow in the reverse direction. A seal could be used that is drillable, operates only in one way or is removed by flow back. In some embodiments, the seal devices may be openable by removal of all or a portion thereof. For example, if the seal is a bridge plug, it can be drilled out or can include a one way valve that closes in response to flow downwardly but opens in response to upwardly flowing fluids so it can be flowed back through. Alternately, if seal 8 is a flowable seal including a removable plug component, for example a ball, the ball may flow back automatically with the back flowing fluids to open the seal.

The above-noted apparatus and process may be used on its own to treat a well or may be combined with other apparatus and/or processes. For example, in one embodiment, the above-noted apparatus and process can be employed in a string that also has graduated size, plug-actuated ports. For example, plug-actuated ports can be installed in one stage of the string, while tool actuated ports are installed in other sections and plug actuation processes can be employed before or after the treatments conducted using the present tool. For example, plug-actuated ports can be employed below that string shown and a plurality of graduated ball sizes can be accommodated for plug-actuated ports and more stages could be opened using the above-noted tool system, even if only no further plug sizes are available. For example, the uppermost ball for the ball-actuated ports, which generally will have the largest diameter, can be used with formable seats in a tool-actuated system, as described herein.

Figure 2:
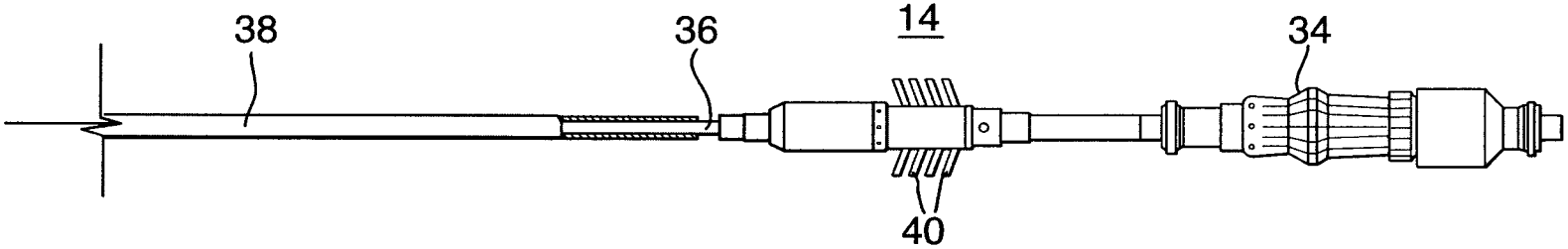
FIG. 2 are a series of schematic illustrations of one embodiment of a wellbore fluid treatment apparatus and a method.

FIG. 2 show an apparatus in greater detail including a ported tubing string 10 for placement in a wellbore, defined by a wall 12, and an actuation tool 14 for actuation of various components of the tubing string. Tubing string 10 includes the illustrated stage, which is positioned directly adjacent the distal end 10*a*. String 10 may include one or more further stages uphole of end 10*c*.

The stage includes a settable tubing string inner diameter seal 18, one or more ports 16 and at least a pair of packers 17. Seal 18 is positioned downhole of, in other words closer to the tubing's distal end 10*a* than, the one or more ports 16. Packers 17 encircle the string's outer surface and straddle the one or more ports 16.

Actuation tool 14 is run inside ported tubing string 10 and can be manipulated by connection to a line 19 from surface to carry out various functions in the string, including opening the string's ports 16 and setting tubing string inner diameter seal 18.

As noted, tubing string 10 includes at least one and likely a plurality of ports 16 through its wall permitting fluid access from the string's inner diameter 10*a* to an annulus 20 between the string and the wellbore wall. Ports 16 are axially spaced apart to permit access through the tubing string inner diameter to spaced apart regions along the wellbore.

Each port 16 has a closure 22, such as a kobe sub, a sleeve valve, etc., associated therewith that is actuable by the actuating tool to open and close the port. The ports can have inserts therein, such as for example, nozzled orifices, to permit controlled fluid flow through each one and to ensure a particular injection profile along the plurality of open ports. The illustrated closures each include a kobe sub 21, including a top cap 21*a* and a mounted end 21*b*. As is common in kobe sub installations, the mounted end is mounted at port 16 and has a bore open to the bore of the port. Top cap 21*a* is solid such that when attached to mounted end 21*b*, it creates a wall against fluid flow through the bore of the mounted end and the kobe is opened by breaking open the top cap, including shearing it off. In this embodiment, each closure 22 further includes a shiftable sleeve 23 in the inner diameter that can be moved axially to shear off top cap 21*a*. One embodiment of such a closure is described in greater detail in FIG. 3.

In the illustrated embodiment, there are a plurality of ports at each port location and movement of one sleeve 23 opens all the ports at that location.

Annular packers 17 can be set to create isolated intervals, for example A, along annulus 20, which is the space between string 10 and wall 12. The packers may be positioned with at least one port between each adjacent pair, such that each isolated interval of the wellbore annulus may be accessed from inner diameter 10*b* via at least one port. Generally, tubing string 10 useful in the invention carries sufficient packers 17 such that a plurality of intervals can be established in the well with at least one port accessing each interval. The packers, when set, control annular migration of fluids though the well. As such, the string may be employed in holes without an annular cementing operation. In particular, the wellbore may be open hole, cased, lined in other ways but need not be cemented between the string and wall 12, if desired. The illustrated packers 17 are open hole packers, each including multiple packing elements 17*a*, 17*b* that can be expanded by hydraulic compression to become set against wall 12.

Tubing string inner diameter seal 18 is settable in the tubing string to create a seal in the inner diameter 10*b*. The seal can be installed in the tubing string in its entirety such that when set, it immediately creates a seal in the string. Alternately, as shown, there can be installed only a portion of the seal such as, for example, a seal seat 25, as shown, that requires the placement of a second part, such as a plug, for example, a ball conveyed to land in the seat, in order for the complete seal to be created. The complete seal, when created, prevents fluid flow through the inner diameter therepast. Thus, when complete, the seal can be employed to prevent fluid introduced to the string from passing the location of the seal such that fluid can be concentrated above the seal and for example, diverted out through any opened ports uphole of the seal. If ports are open below the seal, fluid cannot reach those ports when the seal is complete.

Figure 2A:
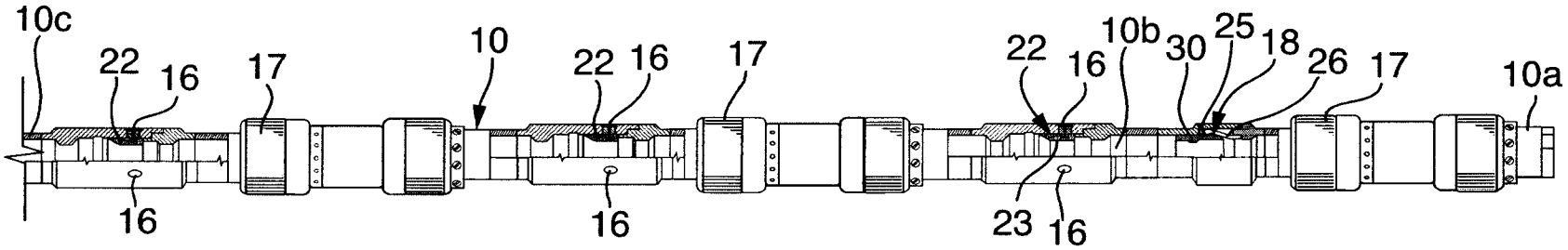
FIG. 2A shows a tubing string in a run in condition.

Seal 18 can be: already installed in the string when it is run in (as shown), carried in on the actuation tool, or conveyable through the tubing string when desired. For example, seal 18 could be an expandable plug, such as for example a bridge plug, carried in on the actuation tool for placement during the setting process, or an expandable plug, a ball seat or a valve (such as glass disc flapper valve) that is installed in the string during run in or a flowable structure lockable into a profile, etc. If the seal is carried on the actuation tool, it may it may be disconnectable from the tool in the setting process before use. If the seal is present in the string during run in, as shown, it may be stored during run in such that the tubing string inner diameter is initially unobstructed by it. For example, fluid flows, actuation tool 14 and possibly other devices may pass through inner diameter 10*b* and past seal 18 substantially without being hindered thereby. In one embodiment, the stored position may present an inner diameter through the seal to maintain the drift diameter in the string, but at least is sufficient to allow fluid and the actuation tool to pass. During the setting process, the seal, which is a part of or the entire seal mechanism, may be released from the stored position to the set position. In the illustrated embodiment, seal 18 includes a flapper ball seat having a plurality of ball seat segments 26 pivotally connected about an annular mount 28 and pivotal between a stored position (FIGS. 2A, 2B) and a set position (FIG. 2C). A sleeve 30 holds segments 26 in a stored position, but is moveable to allow the segments to pivot into the set position, wherein the segments pivot out and come together to form a ball seat 25 capable of accepting and creating a seal with a suitably sized ball 32 (FIG. 2D). Flapper ball seat may alternately include a single curved flapper with a ball seat in the middle. Such a flapper may be flat with the ball seat formed generally centrally therein and pivotal such that the underside of the flapper creates a seal with the flapper seat (to seal against pressures from uphole) Alternately, a single flapper may be convex on its upper surface with the ball seat formed at the apex and positioned such that it will seal against the flapper seat on its underside, which may be concavely formed side. One embodiment of a flapper ball seat is described in greater detail in FIG. 4.

Seal 18 and packers 17 all serve to prevent unwanted migration of fluid through the well. Seal 18 is positioned in the inner diameter to control flow through the inner diameter and packer 17 are positioned about the outer surface of the tubing string to control against annular migration. Thus, considering the location of ports, seal 18 and one or more packers 17 may be suitably positioned between a pair of adjacent ports 16 in order to prevent bypassing flow between adjacent ports around the packer and/or seal 18.

As noted, each stage includes one or more ports 16 with closures 22, a settable tubing string inner diameter seal 18 downhole of the ports and at least a pair of packers 17 to straddle the one or more ports. While the illustrated embodiment shows one stage, it is to be understood that tubing string 10 may have many stages uphole of that shown. Also, while the stage is shown with ports at three axially spaced apart port locations and a packer between each adjacent two locations (i.e. one port location between each adjacent pair of packers), it is to be understood that the stages can be varied in many ways including the number of ports and port locations, the number of ports between each set of packers, the nature, form and construction of the parts, etc.

The apparatus also includes actuation tool 14, which is sized and configured to be moved through inner diameter 10*b* and configured to actuate the closures 22 and seal 18. Tool 14 includes a mechanism for actuating the closures of the ports 16 and a mechanism for setting seal 18. In the illustrated embodiment, the setting of seal 18 and the opening of ports 16 can all be achieved by the shifting of sleeves 23, 30 and, as such, the tool may include a single mechanism for both operations. In particular, the tool includes a no-go shoulder 34 shaped and with a diameter sized to catch a shoulder 23*a*, 30*a* on the sleeves of closures 22 and seal 18.

Tool 14 further includes a connector 36 for connection to line 19 for applying a pull force thereto. The form of connector 36 will depend on the form of the line. Line 19 may extend to surface for application of a pulling force and may be for example a wireline, such as slickline or e-line, or a tubing string, such as of jointed tubing or coiled tubing. The form of line 19 may be selected based on tool requirements. For example, if the tool has a function requiring electricity or some electrical communication is of interest, it may be useful to deploy the tool on e-line. Of course, the tool's connection may alternately be to a string, such as coiled tubing, jointed tubing or rods, but wirelines, such as slickline or e-line, offer considerable efficiencies in terms of cost, time and ease of handling over such string-type connection.

Tool 14 further must be moved downhole. In some embodiments, gravity may be relied upon to move the tool downhole. In other embodiments, such as those where line 19 is a tubing string, and therefore capable of conveying force in compression, the tool may be pushed down through tubing string 10 into position. However, if wireline is employed and the tubing string is employed in a non-vertical hole, then the common modes of applied push and gravity may be of little use. Thus, in some embodiments, tool 14 further includes a transport arrangement for use to move the tool down through the tubing string. In the illustrated embodiment, the transport arrangement includes fins 40 having a diameter and form selected with consideration of the dimensions of inner diameter 10*b* to create a pressure drivable plug in string 10.

The apparatus allows fluid treatment along a plurality of intervals of the well, the plurality of intervals being treated in stages a small number at a time so that the treatment fluids can be focused in those intervals before moving on to the next one or more intervals. Using the apparatus, a seal may be set in the tubing string inner diameter below one or more ports along the tubing string that access one or more isolated intervals and the one or more ports may be opened selectively, such that an operator is able to simultaneously have fluid access to the one or more isolated intervals through the opened ports.

Figure 2B:
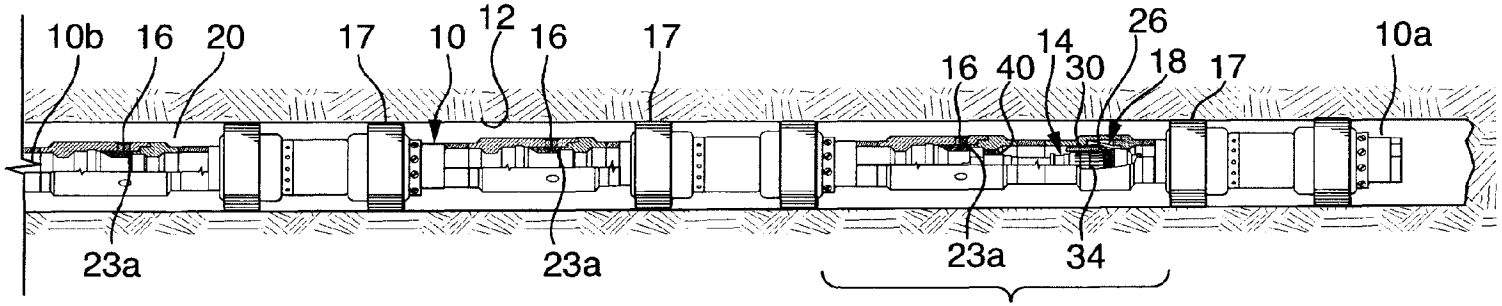
FIG. 2B shows the tubing string installed in a wellbore in the set position and the shifting tool in position ready to activate a plug seat, as for a ball, in the tubing string.
Figure 2C:
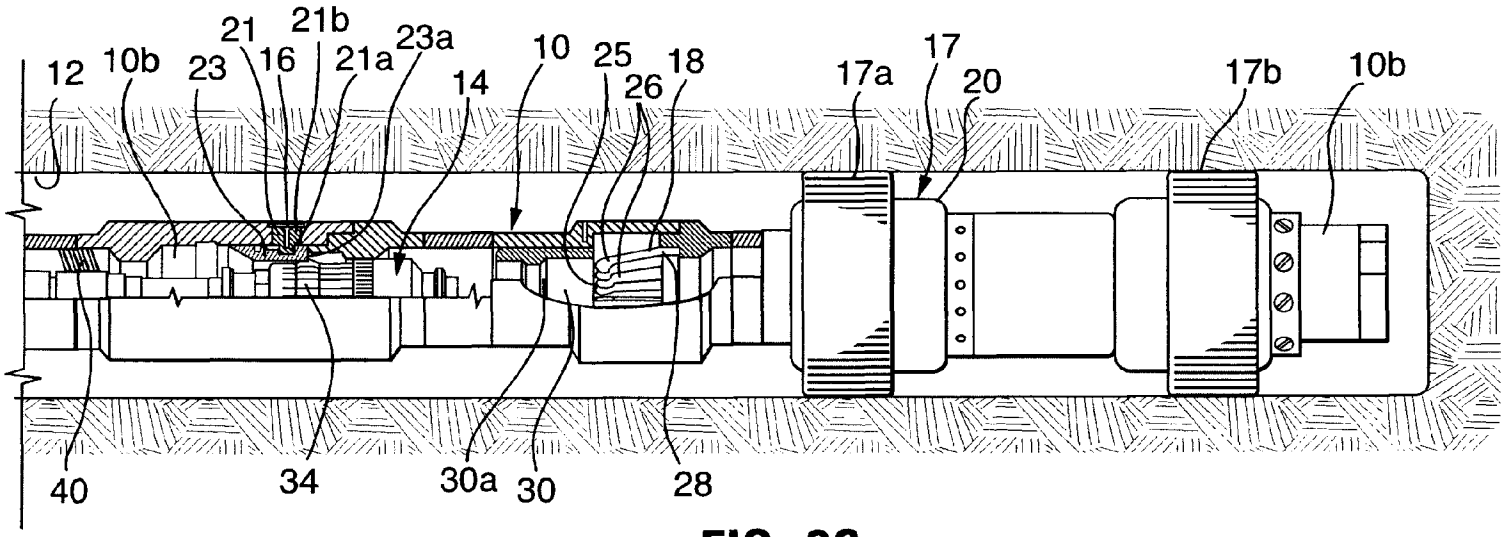
FIG. 2C shows the shifting tool in position ready to open a port.
Figure 2D:
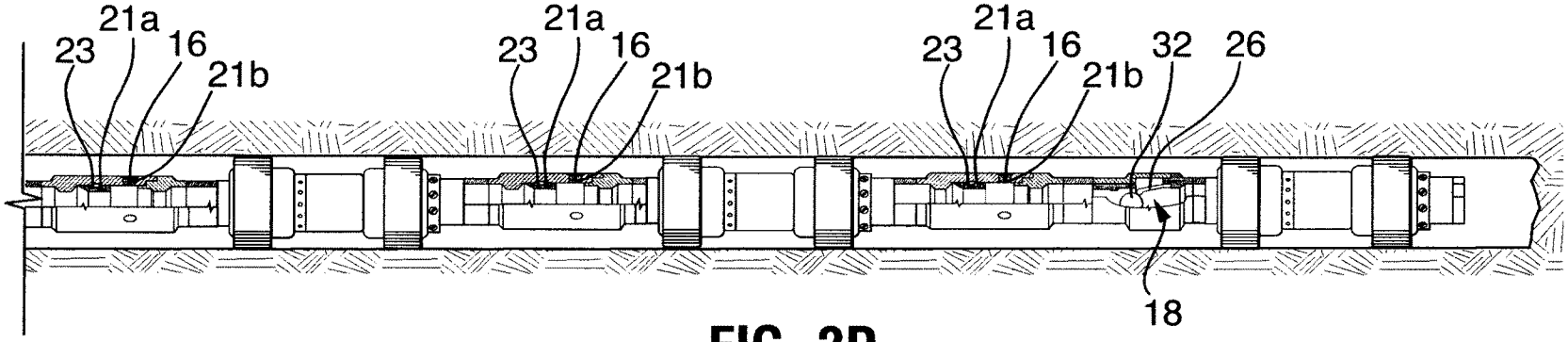
FIG. 2D shows a wellbore fluid treatment apparatus opened along one interval and ready for use to fluid treat the wellbore.

In the method, tubing string 10 in installed in well 12 (FIG. 2B). For example, string 10 is run into the well and, once in position, packers 17 are expanded to set against the wellbore wall and create isolated intervals A along the well. Generally, tubing string 10 is run in with ports 16 closed or all the ports are closed initially after run in, so that one or more selected ports may be opened and fluid can be injected in a known and controlled way through those one or more selectively opened ports.

After installation, tool 14 is conveyed into the well through inner diameter 10*b*. In this embodiment, tool 14 is pumped down using pump pressure against fins 40. This may require the opening of the tubing string to fluid flow, as by opening a port at end 10*a*. Tool 14 is moved down to the stage of interest to set the seal at the bottom of the stage of interest and to open the ports in that stage above the seal. In so doing, tool 14 passes by any ports and seals above the stage of interest without actuating them. Generally, tool 14 is employed to set seal 18 first (FIG. 2B) and then is employed to open ports 16 (FIG. 2C). In the illustrated embodiment, for example, the tool is moved downhole by fluid pressure and, if ports 16 were opened first, it would be difficult to generate enough pressure to pump the tool back down past the opened ports to reach a position below the ports for setting seal 18.

To set seal 18, tool 14 is moved downhole of ports 16 to the location of seal 18. Tool 14 is then employed to set the seal. In the illustrated embodiment, mechanism 34 is positioned downhole of shoulder 30*a* and the tool is moved up, by pulling on line 19 from surface to apply a force against the sleeve. This force overcomes the holding force of any shear pins and moves sleeve 30 to release segments 26. Segments 26 are then freed to pivot out from their stored position and come together to form seat 25 (FIG. 2C). Thus, seal 18 is set, which in this embodiment means that seat 25 is formed and ready to accept a ball, which will be launched when it is desired to generate the complete seal.

Thereafter, tool 14 is disengaged from sleeve 30, for example by pulling past the sleeve once it becomes stopped or by the deactivation of mechanism 34.

Tool 14 is then pulled further up by continued pulling on line 19 from surface, to open ports 16 of the stage. To open a port in this embodiment, the tool is pulled up until mechanism 34 butts against shoulder 23*a*. The tool is moved further up to apply a force against the sleeve through its shoulder 23*a*. The pulling force overcomes the holding force of any shear pins and moves sleeve 23 to shear off top cap 21*a* and move it away from its port 16. Top cap 21*a* is retained under sleeve 23 and does not become loose in the string. Tool 14 is then disengaged from sleeve 23 and can move further up in the tubing string.

Each port 16 in the stage is opened as tool 14 is pulled past. Again, while the illustrated stage includes three ports that are opened sequentially in the same operation, other numbers of ports may be opened. Tool 14 may open at least one port and, for example in one embodiment, three to five ports are opened. Although, further sleeves may be present above the one or more opened sleeves, the further sleeves remain closed.

Thus, after manipulation of tool 14, seal 18 is set and a number of kobe caps 21*a* are removed to open ports 16 and access a plurality of intervals. Tool 14 is then pulled to surface. In this embodiment, tool 14 is first deactivated such that it can pass by further ports sleeves 23 during the trip out without shifting them. In this embodiment, tool 14 may be deactivated by shearing out the supporting members of shoulder 34.

Figure 2E:
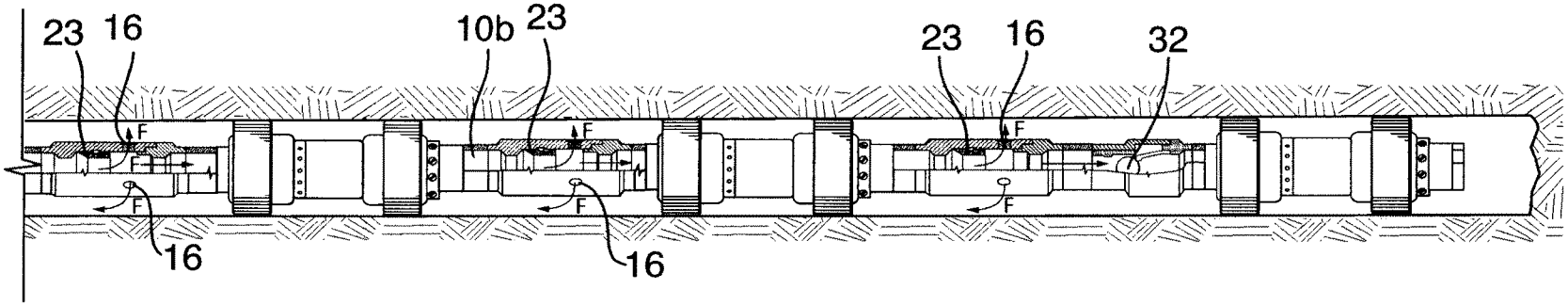
FIG. 2E shows a wellbore fluid treatment apparatus with treatment fluid being conveyed therethrough.

Thereafter, when it is desired to initiate a fluid stimulation through the opened ports 16, seal 18 is completed by dropping a plug, such as ball 32 from surface. Ball 32 moves through string 10 until it reaches the set seal 18 (forming a seat 25) where the ball is stopped and a complete seal is formed in the inner diameter (FIG. 2D). With ball 32 landed on seat 25, fluids are stopped from passing further through inner diameter 10*b* and with further pumping, fluids F, are diverted through opened ports 16 above seal 18 (FIG. 2E).

The treatment fluid passes through ports 16 and enters the isolated intervals accessed by those ports. It is possible, therefore, to simultaneously and selectively frac several intervals. If desired, ports 16 can be fitted with jet nozzles to achieve defined injection volumes through a limited entry method. In particular, using limited entry processes, the total frac volume of injected fluid may be distributed into whatever distribution is desired. The volume of injected fluid passing through a port may be selected based on the pressure drop across a nozzle installed in the port. For example, if three ported stages are opened and fluids are pumped at 100 barrels/minute, it is possible to select port nozzles so that the injected fluid flows substantially evenly through all three ports, for example at about 33 barrels/minute into each ported stage. Alternately, the nozzle sizes might be selected to put 50 barrels/minute through one port and 25 barrels/minute through each of the others. In one embodiment, the nozzle component may be incorporated into kobe base 21*b*. Thus, limited entry methods can be employed, as desired.

Once treatments are finished on those accessed intervals between packers 17, activating tool 14 can employed to open further intervals. For example, tool 14 can be run back in. If the tool has a selective sleeve opening function, it may have been reconfigured to employ a different selective mechanism. If the tool has a non-selective, but sheared out sleeve opening function, the shear tools may have been reset or reinstalled.

Once in position, the tool will set a further seal, above the uppermost port 16, and open a further group of ports uphole of the further seal. Once those further ports are open, the multiple intervals accessed by the further ports can be treated, as by fracing. The further seal plugs fluid access to ports 16 and ensure that fluid only goes to the newly opened further ports. Thus, the process can be repeated as many times as desired until well treatment is completed. Because the required seal is only set when needed, the same size ball and ball seat can be employed at a number of stages in the well. A ball will land in the first set seat at which it arrives.

If the tubing string is to be employed for flowing back, ball 32 and any further balls employed flow back with the fluids. Seat 25, as described above, only holds ball 32 when fluid pressure is applied in a downward direction. If fluid flows toward surface and a ball, even one of the same diameter as ball 32, flows up against seat 25, segments 26 can pivot to move radially outwardly to allow the ball to pass.

While it will be appreciated that other closures can be employed, a captured kobe cap closure as shown in FIG. 2 is shown in greater detail in FIG. 3. In such a closure, the cap can be protected from abutment of tools and strings passing thereby and is removable from its port to open it, but the cap remains captured such that it is not released into the tubing string or into the annulus. For example, as shown, a port 116 can have a closure in the form of a cap 121*a*, 121*b*. The cap includes a base portion 121*b* mounted in the port and a top portion 121*a* that can be sheared from the mounted, base portion. An inner channel extends up through the base portion and into top portion 121*a*, but is closed by top portion. The cap controls the ability of fluid to flow through the inner channel forming the port. In particular, when cap portion 121*a* is in place, connected to base portion 121*b*, fluid cannot flow through the port, it being prevented by the solid form of the cap and the seals encircling the base portion. However, when top portion 121*a* is sheared from the base 121*b*, the channel is exposed and fluid can flow there through. While alternatives are possible, in one embodiment, the cap portions 121*a*, 121*b* may be formed as a unitary part and have a solid, fluid impermeable, but weakened area between them.

A sleeve 123 is positioned over port 116 and cap 121. The sleeve includes an inner surface exposed in the inner diameter 110*b* of the tubing string 110 and an outer surface, facing the tubing string inner wall and including a surface indentation 123*a*. Indentation 123*a* is sized to accommodate top portion 121*a* of the cap therein and is formed such that top portion 121*a* remains at all times captured by the sleeve (i.e. cannot pass out from under the sleeve). Sleeve 123 is moveable within the tubing string inner bore from a position overlying the port and accommodating top portion 121*a* while it is still connected to the base portion, in indentation 123*a*. On its inner facing, exposed surface, the sleeve can be contacted by a sleeve shifting tool, a portion of which is indicated at 114, such as for example in one embodiment similar to tool 14 of FIG. 2. For example, sleeve 123 may include a shoulder 123*b* against which tool 114 can be located and apply force to move the sleeve. Sleeve 123 may be located in an annular recess 141 in order to ensure drift diameter in the tubing string. This positioning also protects the sleeve from inadvertent contact with tools during movement of such tools past the sleeve. Sleeve 123 can include a lock to ensure positional maintenance in the string. For example, sleeve 123 may carry a snap ring 142 positioned to land in a gland 146 in the tubing string inner wall, when the snap ring is aligned with the gland.

Sleeve 123 can be moved to shear the cap and open the port, while retaining the sheared top portion 121*a* in the indentation. For example, during run in and before it is desired to open the port to fluid flow therethrough (FIG. 3A), the cap's top portion 121*a* remains connected and sealed with base portion 121*b*. Sleeve 123 is positioned over the port with portion 121*a* positioned in indentation 123*a*.

Figure 3A:
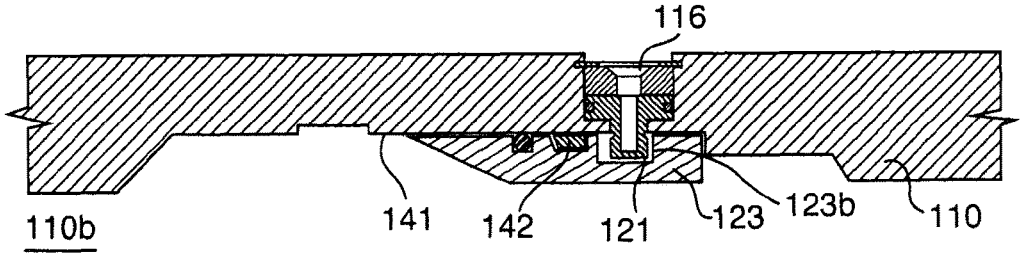
FIG. 3A shows a port closure in a run in condition.
Figure 3B:
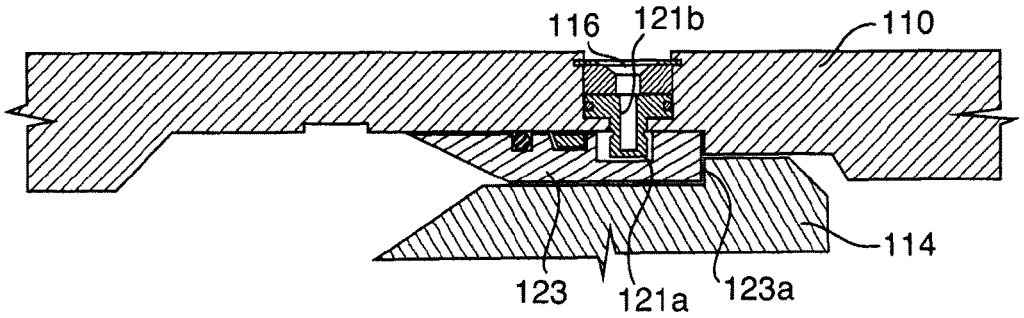
FIG. 3B shows the closure with a shifting tool in position ready to open the port.
Figure 3C:
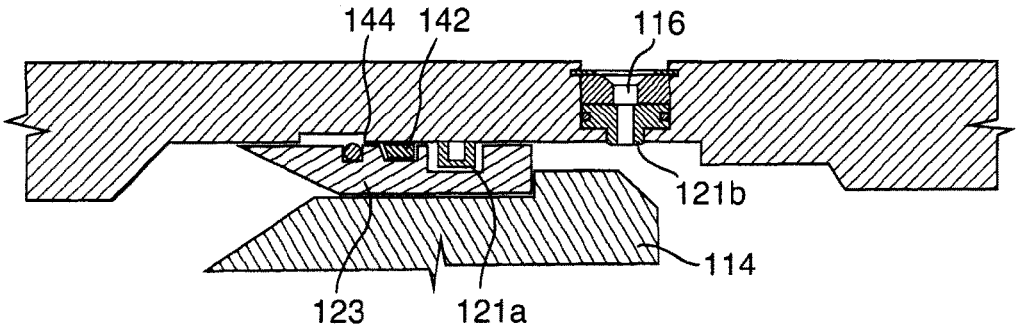
FIG. 3C shows the closure immediately after opening and ready for use to fluid treat the wellbore.

When it is desired to open the port, sleeve 123 can be moved, as by landing a tool 114 against the sleeve, such as shoulder 123*b* of the sleeve, (FIG. 3B) and, applying a push, pull or rotational force to the sleeve to move it along the tubing string (FIG. 3C). When sleeve 123 moves, force is applied to the cap top portion 121*a* by abutment of the side walls of the indentation against portion 121*a*. Since top portion 121*a* is urged to move, while base 121*b* is fixed, portion 121*a* becomes sheared from base portion 121*b*. While removal of top portion 121*a* opens the port, the sleeve 123 with the sheared top portion 121*a* captured therein can be slid until it fully exposes port to the inner bore. For example, sleeve 123 can be moved until it becomes locked, as by snap ring 142 landing in gland 144 in a displaced position, while top cap portion 121*a* remains captured in indentation 123*a*.

Figure 3D:
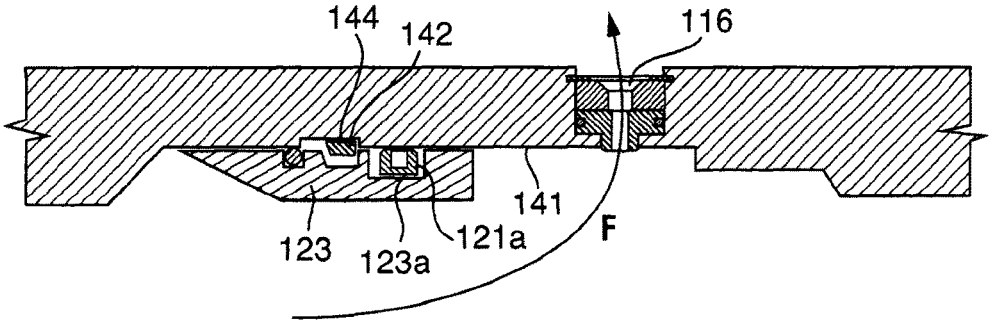
FIG. 3D shows the closure with fluid passing therethrough.

Fluid, such as fracing fluid F, may be pumped out through the channel forming port 116, which is exposed by opening the cap (FIG. 3D).

Figure 4:
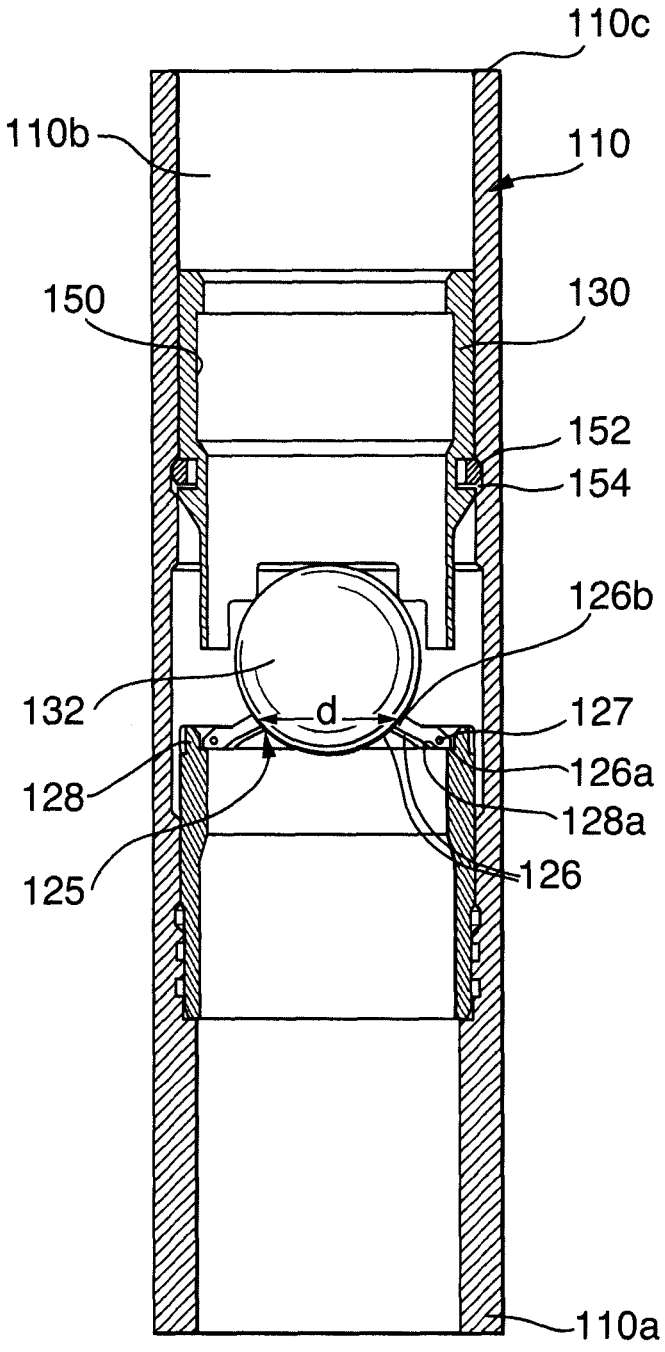
FIG. 4 is a sectional view through a flapper ball seat.

While it is to be appreciated that various seals may be employed, a flapper ball seat is described in greater detail with reference to FIG. 4. A flapper ball seat device 123 includes a plurality of ball seat flapper segments 126 pivotally connected about an annular mount 128 in a tubular housing 110. Each flapper segment 126 is pivotal between a stored position and a set position (FIG. 4). A sleeve 130 holds segments 126 in a stored position, but is moveable to allow the segments to pivot into the set position. When sleeve 130 is moved from a position overlapping the flapper segments (a stored position) to a position away from, not overlapping the segments, a released position as shown in FIG. 4, segments 126 pivot out about their pivotal connections 127 and come together to form a ball seat 125 capable of accepting and creating a seal with a suitably sized plug such as ball 132 or another form of plug such as a dart. Biasing members may be installed at pivotal connections 127 to ensure that the segments pivot inwardly when they are released by sleeve 130.

Sleeve 130 includes a bore 130 therethrough that is open to a bore 110*b* formed through the tubular housing. Tubular housing 110 may be connected into a longer string such as string 10. Ends 110*a*, 110*c* may be formed to facilitate such connection.

In the illustrated embodiment, flapper ball seat device 123 is intended to be employed in a well treatment apparatus, as described herein. Thus, sleeve 130 is installed to move upwardly when moving from the overlapping position to the non-overlapping position so that it can be moved by a shifting tool, such as tool 14 (FIG. 2), being pulled upwardly therethrough. Sleeve 130 includes a profile 150 into which a shifting tool can land and engage to move the sleeve. It is to be understood, however, if the flapper ball seat device is used in other embodiments, sleeve 130 may alternately shift down to release segments and/or may be moved by other means of intervention strings or remote actuation such as by a launchable plug landable in a seat in the sleeve.

Sleeve 130 carries a locking device to retain the sleeve in the released position, when it is moved. For example, sleeve 130 can be moved until it becomes locked, as by a snap ring 152 landing in a gland 154.

There can be any number of segments in the seal device. Segments 126, when stored, are positioned between the inner wall of housing 110 and sleeve 130. Housing 110 can have an annular recess formed therein to accommodate the segments. However, since the segments can be individually relatively thin, can have a minimal side to side width and can be curved from side edge 126*c* to side edge 126*c*, little annular space is needed for their storage.

Segments 126 include base ends 126*a*, where they are pivotally connected to mount, and free ends 126*b*, which are the ends that come together to define the ball seat 125. The finally formed ball seat resembles an annular ring and the base end of each segment is a portion of an outer edge of the annular ring and the free end is a portion of a circular opening of the annular ring. Segments 126 are therefore generally triangular in plan view, wherein their side edges 126*c* taper from the base ends to free ends 126*b*, but are cut at the free ends to form a portion of a curve, together forming the substantially circular curvature of the ball seat.

Annular mount 128 can act as a stop to limit the pivotal movement of the segments. In particular, each base end 126*a* may include an angular shoulder and annular mount 128 may include a corresponding shaped stop wall (a flat or a shoulder) positioned in the pivotal path of the angular shoulder of the segment.

Segments 126 are formed at their base ends 126*a* to define a surface seatable against annular mount 128. Thus, when the segments pivot out into the position forming a ball seat, base ends 126*a* substantially seat and seal against annular mount 128, which in effect creates a flapper seat. Segments 126 are also formed along their side edges such that when they come together few flow gaps remain except through the opening between ends 126*b*, which is the open diameter d of ball seat 125. In particular, when the segments come together the structure of the seat formed effectively presents a solid body except across the ball seat diameter. The final structure formed when the segments come together may be convex on its upper surface with the ball seat positioned at the apex, as shown, or the structure may be flat.

When the seat is formed convex on its upper surface, it may be concave on its lower surface, as shown. Thus, segments may have a substantially uniform thickness from end 126*a* to end 126*b*.

In use, device 123 is run in hole with housing 110 attached into the liner. The liner is set in the well such as for example, by setting packers, liner hangers, etc. When it is desired to set the ball seat in an active position, sleeve 130 is shifted to release segments 126 to pivot radially inwardly. Sleeve 130 may be shifted by a shifting tool, such as tool 14, engaged in profile 150 or by other means such as another invention string or remotely by a dropped ball, electrical driver, etc.

By movement of the sleeve, flapper segments 126 are free to pivot and come together forming ball seat 125 in the inner diameter 110*b*. The segments pivot radially inwardly toward a center axis of the tubular housing to assume an active position where the plurality of ball seat segments fit together to form a ball seat with a central ball seat opening substantially concentric about the center axis.

A ball 132 may then be launched from surface to land in on the formed seat 125. Pressure may be increased uphole of the ball (towards end 110*c*), as ball 132 and seat 125 together create a complete seal in the inner diameter that isolates the inner diameter below device 123 from the inner diameter above the seat. Any stress in segments 126, caused by ball 132 being pushed downwardly thereon, is transmitted into annular mount 128 in which the segments are installed. For example, in a convex-shaped seat, as shown, stresses force the side edges 126*c* into closer engagement and are directed axially down from free ends 126*b* through the segment bodies to base end 126*a* and thereafter into annular mount 128 against which the segments are shouldered. The stresses, therefore, drive the individual parts into close engagements such that the pressure seal is set up.

Pressure operations can be conducted above the seal, as desired, for example as described above. Since the flapper ball seat can be held retracted in a stored position until it is needed, it does not create any stop to balls passing thereby until it is released. As such, where a plurality of the flapper ball seats are installed in the liner, the same size ball can be run to seat in them. For example, even where there are a plurality of flapper ball seats from heel to toe, the segments of the ball seat devices can all be selected to form the same size ball seat diameter d and can be formed to form a seal with the same size ball. However, provided the segments are retained behind the sleeve, the ball will pass any stored seats to reach its set seat, even if it is the lowermost seat in the string.

When pressure is dissipated from above, ball 123 will flow back toward surface (toward end 110*c*), as driven by backflowing fluids. Since the flapper segments are free to pivot back radially outwardly, and therefore form a seat that only holds in the downhole direction, the flappers flow off their flapper seat in response to fluid driven forces from below. This provides a large inner diameter in the housing with no restriction compared to a traditional, fixed ball seat.

If required, seat, flapper segments and/or annular mount can be milled out. Because there are a plurality of individual components milling may be more easy than the milling of a traditional ball seat.

Figure 5:
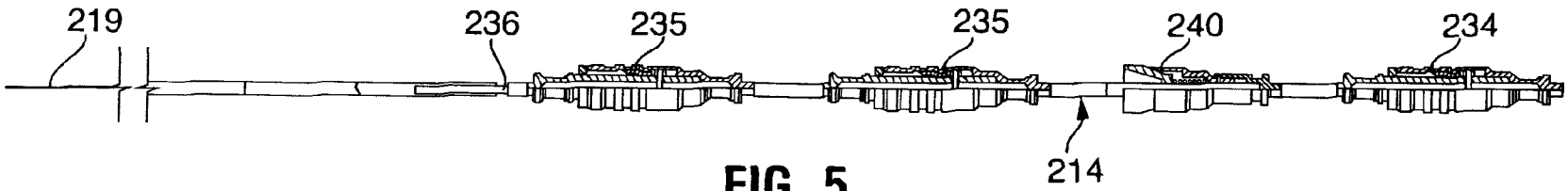
FIG. 5 are a series of schematic illustrations of one embodiment of a wellbore fluid treatment apparatus and a method.

With reference to FIG. 5, another embodiment of an apparatus for well treatment is shown. The apparatus includes a tubing string 210 and an actuation tool 214. Tubing string 210 includes a settable tubing string inner diameter seal 218, a plurality of ports 216*a*, 216*b*, 216*c* (collectively referred to as ports 216) and a plurality of packers 217. Tubing string 210 further includes a mechanism 260 to deactivate the actuation tool. Seal 218 is positioned downhole of ports 216 and mechanism 260 is positioned uphole of the ports. Packers 217 encircle the string's outer surface and straddle the one or more ports 216.

In this embodiment, seal 218 is a sleeve-stored, shift to activate flapper ball seat; ports 216 are each covered by identical shift to open sleeve valves; mechanism 260 is a profile nipple used to deactivate shifting tools; and packers 217 are Rockseal™ packers particularly suited for openhole (non-cased) installations, having dual, extrudable packing elements.

Actuation tool 214 is sized and configured to be moved through inner diameter 210*b* of the tubing string and configured to actuate by shifting the sleeves of ports 216 and seal 218. Tool 214 includes a mechanism for shifting the sleeve closures of ports 216 and a mechanism for setting seal 218. In the illustrated embodiment, the tool includes a modified "B" shifting tool 234 selected to shift sleeve 230, which store the ball seat segments 226 of the seal, and a pair of standard "B" shifting tools 235 for shifting the sleeves 223 covering the ports. The tools 235 are employed in duplicate for redundancy. A "B" shifting tool is described, for example, in U.S. Pat. No. 3,051,143.

Tool 214 further includes a connector 236 for connection to a slickline 219. Connector 236 may include a stem and one or more jars. Tool 214 further includes a pump down cup 240 that can be deactivated by applying a suitable pressure thereto. The pump down cup 240 when in active form creates an annular seal about the tool preventing fluid passage downwardly past the seal and, therefore, allows tool 214 to be pushed downhole by fluid pressure, pulling the slickline behind. Slickline 219 can be used to pull the tool back toward surface after it is placed by fluid pressure.

In use, tubing string 210 is run into a wellbore and set in place, for example, by setting packers 217 to engage the open hole wellbore wall. This creates isolated intervals between each adjacent pair of packers along the wellbore annulus.

Tool 214 is then run into the hole through inner diameter 210*b*. To do so, pump down cup 240 is in an activated position to hold pressure and fluid is pumped from above to push the tool through the inner diameter, with the slickline pulled along behind. Fluid is pumped behind the tool until it is in position. In this embodiment, after any stages below the tubing string are manipulated and treated, the tool is run in to a position below a selected stage of the tubing string, which in this embodiment is a position with shifting tool 234 below seal 218.

Figure 5A:
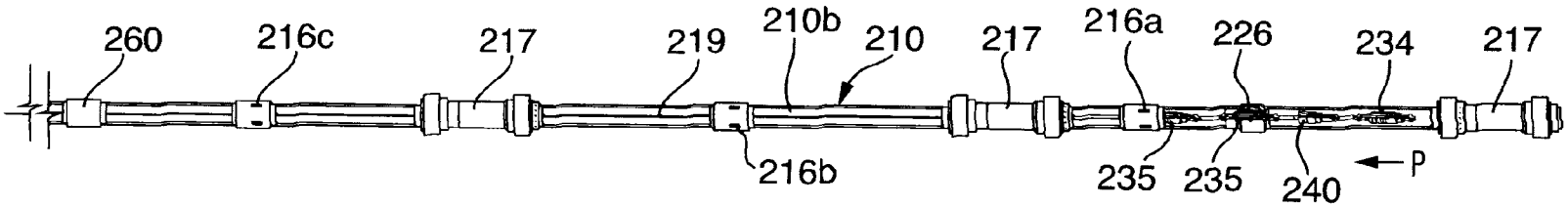
FIG. 5A the actuator tool in a tubing string and in position ready to set a seal.

Cup tool 240 may then be deactivated by holding slickline and applying a sufficient fluid pressure from above that actuates the deactivation mechanism of the cup tool (FIG. 5A). The cup tool then can no longer hold pressure and can be readily pulled up hole.

Figure 5B:
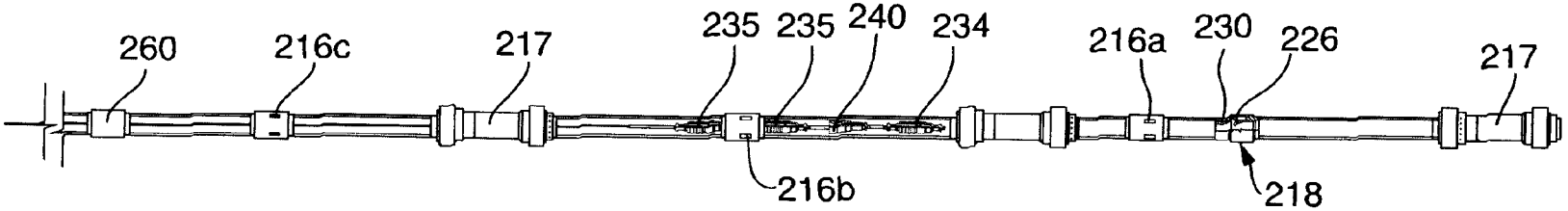
FIG. 5B shows the shifting tool in position ready to open a port.

Tool 214 can be pulled up, arrow P, until shifting tool 234 engages sleeve 230. Once shifting tool engages in the seal's sleeve profile, sleeve 230 can be jarred upwardly away from ball seat segments 226. The ball seat segments are thereby released dropping into position (FIG. 5B). Shifting tool 234 is modified such that it will only shift one sleeve before it is deactivated. After shifting tool 234 sets seal 218, shifting tool 234 shear deactivates such that it can pass all other sleeves of ports 216 or other seals or ports elsewhere in the tubing string without engaging them.

Thereafter, tool 214 is lifted up until one of shifting tools 235, likely the uppermost one, engage the sleeve of the lowest port 216*a*. By jarring on tool 214, the bottom port 216*a* is opened, rendering the ports 216*a* open for fluid flow therethrough. Once a sleeve is shifted, tool 235 automatically releases from the sleeve. Thereafter, again tool 214 is lifted up until one of shifting tools 235 engage the sleeve of the next port 216*b* and a pulling force is applied to open that port (FIG. 5B).

This port opening process is repeated again on port 216*c* to open that port.

Since a "B" shifting tool is configured to shear deactivate, in some situations a shifting tool may shear prematurely. In other situations, a shifting tool can only withstand a set number of shifts before deactivating. Thus, the use of multiple port shifting tools 235 offers redundancy to ensure that all ports in a stage can be opened in one run.

After all ports 216 in the stage are opened and tool 214 is pulled toward surface. As tools 234, 235 pass through profiled nipple 260, any that are not already deactivated are deactivated. As shifting tools 234, 235 pass the profiled nipple, the keys engage the profile and all of the jarring force is applied to the tool shear pins. This process will shear any shifting tools that aren't already sheared. Once a shifting tool is sheared, it will not engage a profile again, therefore, it will not shift any sleeves that it passes as it is pulled up through diameter 210*b* and out of the hole.

Figure 5C:
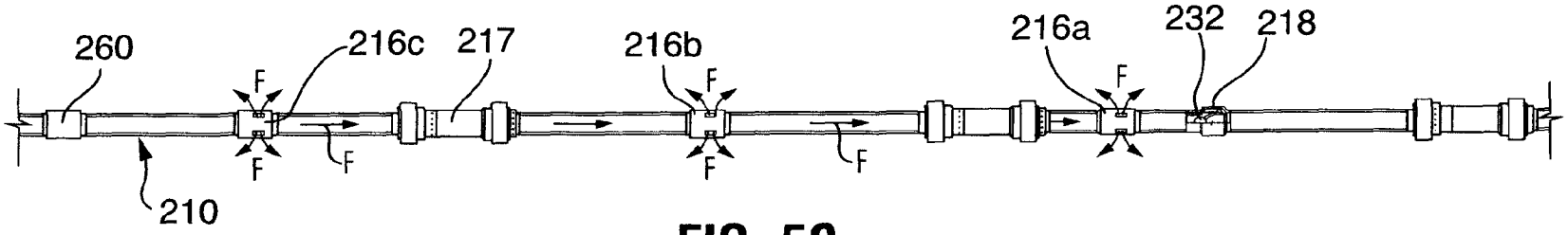
FIG. 5C shows the tubing string undergoing a wellbore fluid treatment.

After slickline 219 is pulled to pull the tool to surface, the stage is ready to be fluid treated, as by fracing. To do so, first a plug, such as ball 232, is dropped, as shown in FIG. 5C. The ball is a selected size to land in and seal with the ball seat formed by setting seal 218. The ball will land on the activated ball seat when it reaches it, creating a complete seal in the inner diameter below ports 216 which isolates those ports from any stages, including open ports if any, below.

Frac fluid is then pumped, arrows F, through tubing string 210 and out the opened ports 216 to treat the formation about the string. The complete seal provided by ball 232 in the seat of seal 218 ensures that fluid is diverted out through the opened ports. Ports 216 can be reduced, as by use of nozzles, to distribute the frac fluid as desired.

Once the frac treatment is complete, tool 214 is run in again on slickline 219. Before run in, tools 234, 235 of the actuation tool are reset with new shear pins. The above-noted process is then repeated on further stages of the string uphole of the illustrated stage.

Figure 5D:
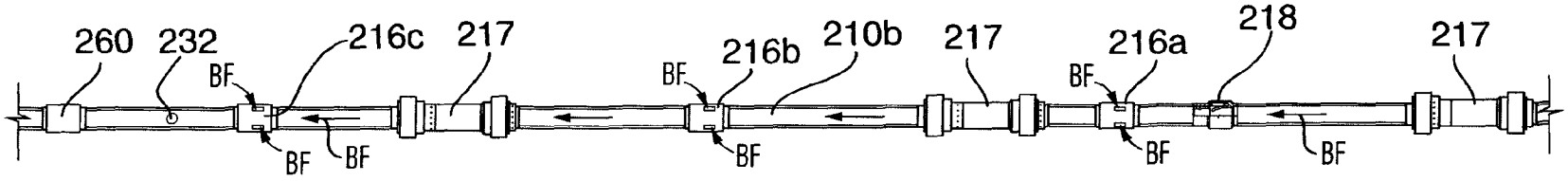
FIG. 5D shows the tubing string with a backflow of fluids passing therethrough.

Once all selected stages are fraced, the well, as shown in FIG. 5D, is put on production and the plugging balls, such as ball 232, are either pumped out by backflowing fluids, arrows BF, or they degrade with the presence of hydrocarbons. In this illustrated embodiment, all ports are closeable by shifting back their sleeve closures. Thus, ports 216 can be reclosed if needed for reservoir management, for example, where shut-off is desired in a watered out stage.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A wellbore fluid treatment apparatus comprising:

a tubing string including a first port with a first closure disposed thereover to close the first port to fluid flow and a second port spaced axially uphole from the first port and having a second closure disposed thereover to close the second port to fluid flow, the first port and the second port having limited entry inserts installed therein for selection of fluid distribution between the first port and the second port; and an actuator tool including a pump down annular seal, a detachable seal configured for installation in the tubing string and a wireline connector for attachment to wireline, the actuator tool configured to be pumped down using the pump down annular seal and pulled up through the tubing string and (i) to set the detachable seal in the tubing string downhole of the first port; (ii) to actuate the first closure to open the first port; and (iii) to actuate the second closure to open the second port.

2. The wellbore fluid treatment apparatus of claim 1 wherein the actuator tool is configured (ii) to actuate the first closure to open the first port; and (iii) to actuate the second closure to open the second port when moving upwardly through the tubing string.

3. The wellbore fluid treatment apparatus of claim 1 wherein the first closure is a sliding sleeve.

4. The wellbore fluid treatment apparatus of claim 1 wherein the first closure is a kobe sub.

5. The wellbore fluid treatment apparatus of claim 1 wherein the actuator tool includes a mechanism for remote deactivation such that the actuator tool can be rendered incapable of actuating closures or setting seals while in the tubing string.

6. The wellbore fluid treatment apparatus of claim 1 wherein the tubing string includes a second stage uphole of the second port and the second stage includes a lower port with a closure disposed thereover to close the lower port to fluid flow and an upper port spaced axially uphole from the lower port and having a closure disposed thereover to close the upper port to fluid flow; and the actuator tool is configured to move through the tubing string and (i) to set a second seal in the tubing string between the second port and the lower port; (ii) to actuate the closure of the lower port to open the lower port; and (iii) to actuate the closure of the upper port to open the upper port.

7. The wellbore fluid treatment apparatus of claim 1 wherein the detachable seal is an expandable plug, the expandable plug being positionable between a stored position and a set position and the actuator tool is configured to set the detachable seal by actuating the expandable plug from the stored position to the set position.

8. The wellbore fluid treatment apparatus of claim 1 wherein the wireline connector accepts electrical power and signaling and the actuator tool includes an electrical motor for opening the first port.

9. A method for fluid treating a wellbore through a tubing string including a first port with a first closure disposed thereover to close the first port to fluid flow and a second port spaced axially uphole from the first port and having a second closure disposed thereover to close the second port to fluid flow, the method comprising:

running into an inner diameter of the tubing string with an actuator tool;

manipulating the actuator tool to set a seal in the inner diameter downhole of the first port, wherein manipulating includes detaching a sealing member from the actuator tool and installing the sealing member in the tubing string;

pulling the actuator tool up to the first port;

actuating the first closure with the actuator tool to open the first port;

pulling the actuator tool up to the second port;

actuating the second closure with the actuator tool to open the second port; and injecting wellbore treatment fluid into the tubing string inner bore, the wellbore treatment fluid being diverted by the seal out through both the first port and the second port simultaneously.

10. The method of claim 9 wherein running in includes pumping fluid behind the actuator tool to push the actuator tool into the inner diameter.

11. The method of claim 9 wherein pulling the actuator tool up includes pulling on a wireline attached to the actuator tool.

12. The method of claim 11 wherein pulling the actuator tool up includes deactivating a pump down seal on the actuator tool.

13. The method of claim 9 wherein before injecting, the method further comprises pulling the actuator tool out of the tubing string.

14. The method of claim 9 wherein actuating the first closure includes moving the actuator tool upwardly past the first port and removing the first closure from the first port.

15. The method of claim 14 wherein the first closure is a sliding sleeve and removing includes shifting the sliding sleeve axially upwardly.

16. The method of claim 14 wherein the first closure is a kobe sub and removing includes breaking open the kobe sub.

17. The method of claim 9 wherein after actuating the second closure and before injecting, the method further comprises actuating further closures to open further ports uphole of the second port.

18. The method of claim 9 wherein before injecting, the method further comprises deactivating the actuator tool such that the actuator tool is incapable of actuating any further closures and incapable of setting any further seals.

19. The method of claim 9 wherein the method further comprises, after injecting: moving the actuator tool to another position in the tubing string uphole of the second port; manipulating the actuator tool to set a second seal in the inner diameter uphole of the second port; pulling the actuator tool up to a further port; actuating a closure for the further port with the actuator tool to open the further port; and injecting further wellbore treatment fluid into the tubing string inner bore, the further wellbore treatment fluid being diverted by the second seal out through the further port.

20. The method of claim 19 wherein the seal is a ball seat installed in the tubing string and the second seal is a second ball seat installed in the tubing string and manipulating the actuator tool to set the second ball seat includes moving the second ball seat from a stored to an active position and wherein before injecting wellbore treatment fluid, the method further comprises dropping a plug to land in the ball seat and to create a complete seal with the ball seat, the plug passing through the second ball seat to land in the ball seat.

21. The method of claim 20 wherein before injecting further wellbore treatment fluid, the method further comprises dropping a second plug to land in the second ball seat, the second plug having a diameter substantially similar to the plug.

22. The method of claim 9 wherein:

running includes pumping the actuator tool on wireline and bypassing uphole ports without actuation of the uphole ports;

and pulling the actuator tool includes pulling on the wireline; and injecting wellbore treatment includes portioning the wellbore treatment fluid between the first port and the second port by limited entry inserts in the first port and the second port.

23. The method of claim 22 further comprising supplying power and signaling the actuator tool through the wireline to control actuating and bypassing.

24. A wellbore fluid treatment apparatus comprising:

a tubing string including a first port with a first closure disposed thereover to close the first port to fluid flow and a second port spaced axially uphole from the first port and having a second closure disposed thereover to close the second port to fluid flow, the first port and the second port having limited entry inserts installed therein for selection of fluid distribution between the first port and the second port and a second stage uphole of the second port and the second stage includes a lower port with a closure disposed thereover to close the lower port to fluid flow; an upper port spaced axially uphole from the lower port and having a closure disposed thereover to close the upper port to fluid flow; and a second seal device installed axially between the lower port and the second port, and;

an actuator tool including a pump down annular seal and a wireline connector for attachment to wireline, the actuator tool configured to be pumped down and pulled up through the tubing string and configured (i) to set a seal in the tubing string downhole of the first port; (ii) to actuate the first closure to open the first port; (iii) to actuate the second closure to open the second port and the actuator tool is further configured to move through the tubing string; (iv) to set a second seal in the tubing string between the second port and the lower port by actuating the second seal device; (v) to actuate the closure of the lower port to open the lower port; and (vi) to actuate the closure of the upper port to open the upper port.

25. The wellbore fluid treatment apparatus of claim 24 wherein the actuator tool is configured to set the seal below the first port by actuating a ball seat installed in the tubing string and the second seal device is a second ball seat, and the ball seat and the second ball seat have the same diameter.

* * * * *